US006560781B1

(12) United States Patent
Keene et al.

(10) Patent No.: US 6,560,781 B1
(45) Date of Patent: May 13, 2003

(54) BASEBALL CATCHER'S FOOT AND TOE GUARD

(75) Inventors: Scott M. Keene, Collinsville, IL (US); Daniel J. Cullinane, Maryland Heights, MI (US); Sally V. Yeast, Frontenac, MI (US)

(73) Assignee: Rawlings Sporting Goods Company, Inc., Fenton, MI (US)

( * ) Notice: Subject to any disclaimer, the term of this patent is extended or adjusted under 35 U.S.C. 154(b) by 0 days.

(21) Appl. No.: 10/116,997

(22) Filed: Apr. 5, 2002

(51) Int. Cl.[7] ..... A41D 13/00
(52) U.S. Cl. ..... 2/22
(58) Field of Search ..... 2/22, 23, 24, 62, 2/16, 242, 267, 455, 911, 465; 128/846, 878, 882; 36/1.5, 2 R; 602/5, 20, 23, 60, 26–30, 62, 65; D24/190, 192; D29/100, 120.1, 121.1

(56) References Cited

U.S. PATENT DOCUMENTS

| | | | | | |
|---|---|---|---|---|---|
| 1,437,599 | A | | 12/1922 | Lindhard | |
| 1,624,129 | A | | 4/1927 | Barrett | |
| 1,777,088 | A | | 9/1930 | Horath | |
| 2,717,387 | A | | 9/1955 | McMahan | |
| 2,733,443 | A | | 2/1956 | Holder | |
| 2,982,968 | A | | 5/1961 | Groot | |
| 3,153,864 | A | * | 10/1964 | Brewer | 36/2 R |
| 3,761,960 | A | | 10/1973 | Woodcock | |
| 4,057,853 | A | | 11/1977 | McLane | |
| 4,344,189 | A | | 8/1982 | Futere et al. | |
| 4,494,534 | A | | 1/1985 | Hutson | |
| 4,497,070 | A | | 2/1985 | Cho | |
| 4,503,566 | A | | 3/1985 | Wheeler | |
| 4,608,718 | A | * | 9/1986 | Reed | 2/22 |
| 4,624,015 | A | | 11/1986 | Bottoms | |
| 4,633,529 | A | | 1/1987 | Litz | |
| 4,674,157 | A | | 6/1987 | Litz | |
| 4,692,946 | A | | 9/1987 | Jurga | |
| 5,056,158 | A | | 10/1991 | Lutz | |
| 5,301,370 | A | | 4/1994 | Henson | |
| D361,869 | S | | 8/1995 | Paffett et al. | |
| 5,452,475 | A | | 9/1995 | Hunt, Jr. | |
| 5,507,720 | A | | 4/1996 | Lampropoulos | |
| 5,732,411 | A | * | 3/1998 | Coleman et al. | 2/22 |
| 5,742,938 | A | | 4/1998 | Winningham et al. | |
| 5,794,261 | A | | 8/1998 | Hefling | |
| 5,970,525 | A | | 10/1999 | Gallinot et al. | |
| 6,178,556 | B1 | * | 1/2001 | Foreman et al. | 128/882 |
| 6,187,555 | B1 | | 2/2001 | Tautvydas | |

FOREIGN PATENT DOCUMENTS

| | | |
|---|---|---|
| CA | 967302 | 5/1975 |

* cited by examiner

*Primary Examiner*—Gloria M. Hale
*Assistant Examiner*—Tejash Patel
(74) *Attorney, Agent, or Firm*—Stinson Morrison Hecker LLP

(57) ABSTRACT

A baseball catcher's leg guard comprises a wrap-around foot guard configured to extend down the sides of a catcher's foot to protect the foot and limit lateral movement of the foot guard.

20 Claims, 3 Drawing Sheets

20
22
10
24
30
26

BASEBALL CATCHER'S FOOT AND TOE GUARD

CROSS-REFERENCE TO RELATED APPLICATIONS

Not Applicable.

STATEMENT REGARDING FEDERALLY SPONSORED RESEARCH OR DEVELOPMENT

Not Applicable.

BACKGROUND OF THE INVENTION

1. Field of The Invention

The present invention relates generally to sport player's protective wear, and is more particularly directed to a wrap-around foot guard configured to cover a portion of the top and sides of a user's foot in a manner to limit lateral movement of the foot guard when in use.

2. Description of Related Art

In the game of baseball, the catcher typically wears articles of protective equipment, including a chest guard and leg guards. Conventional leg guards include individual padded guard units for protecting the catcher's thighs, knees, shins, feet and toes that are pivotally joined together via straps or other means. The padded guard units are typically comprised of relatively hard shells with padding secured under the shells. The leg guards are typically secured by straps around a catcher's thighs and calves to hold the guards in place.

In specific relation to protection of the feet and toes, a conventional foot guard is generally oval in shape and configured to cover the top of a portion of the foot. A lower toe guard may be secured to the end of the foot guard to cover the toe end of the foot. The foot and toe guards typically lie on the top of the catcher's foot and are not otherwise secured to the foot. Thus there is a tendency for these guards to fall to the side of the foot when in use.

While the prior leg guard configurations are useful, there remains a need for an improved leg guard that offers improved protection of the catcher's foot and toes while also providing improved placement and securement of the entire leg guard.

BRIEF SUMMARY OF THE INVENTION

The present invention is directed to a wrap-around foot guard shaped to cover a portion of the top and sides of a catcher's foot so as to limit lateral movement of the foot guard when in use. The foot guard comprises a mid-section configured to cover a portion of the top of the foot and opposing sides extending downward a substantial distance along either side of the foot. For purposes of this invention, a "substantial distance" means a distance sufficient to cover a portion of the side of the foot such that the sides of the foot serve to block lateral movement of the guard. Preferably, the opposing sides of the foot guard extend at least one-quarter (¼) the distance between the top and bottom of the foot, preferably ranging from one-half (½) to three-quarters (¾) that distance. In order to further limit lateral movement, the foot guard may be configured to include lobes extending rearwardly adjacent the user's ankle.

A preferred embodiment of the present invention is directed to a catcher's leg guard comprising a wrap-around foot guard as described above coupled to the lower portion of a shin guard. Since lateral movement of the foot guard is limited, the foot guard provides a stabling effect to prevent the lower portion of the shin guard from moving side-to-side. A lower toe guard configured to cover the toe end of the foot may also be connected to the foot guard to provide additional toe protection. The secured placement of the foot guard will also assist in limiting lateral movement of the toe guard. Thus, in the preferred embodiment, the wrap-around foot guard provides improved protection of the catcher's foot as well as improving the placement and securing of the shin guard portion and toe guard portion of a leg guard.

DETAILED DESCRIPTION OF PREFERRED EMBODIMENT

Figure 1:
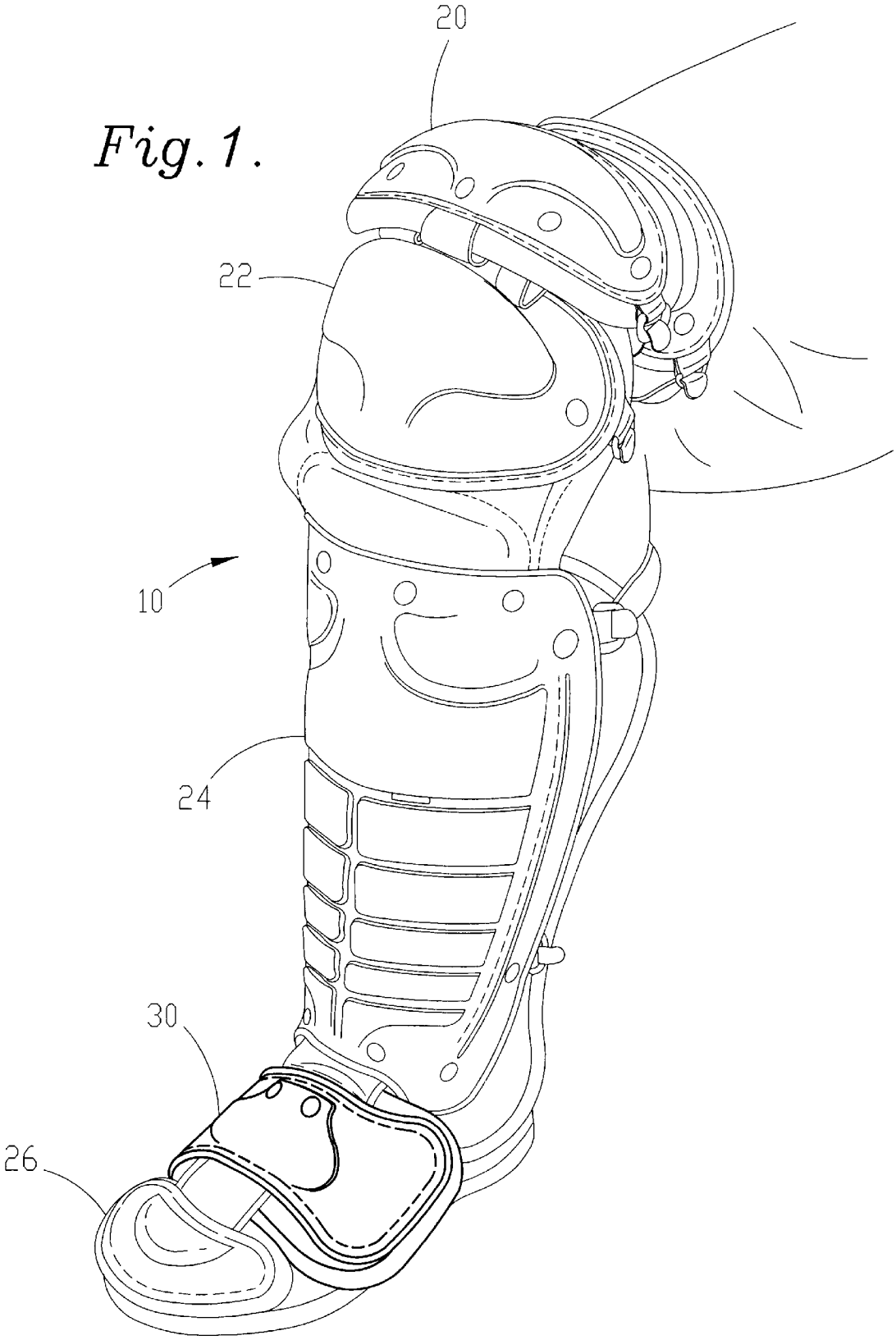
FIG. 1 is a perspective view of a leg guard including a foot guard in accordance with the present invention.

Looking to FIG. 1, a chatcher's leg guard made in accordance with a preferred embodiment of the present invention is generally designated by the numeral 10. Leg guard 10 is preferably worn on the front of the catcher's leg to protect that portion of the leg and foot from pitched or foul-tipped baseballs. Leg guard 10 comprises a thigh guard 20, a knee guard 22, a shin guard 24, a wrap-around foot guard 30, and a lower toe guard 26 flexibly coupled to one another. The overall configuration, materials and method of manufacture used for leg guard 10 and for the individual thigh guard 20, knee guard 22, shin guard 24 and lower toe guard 26 components, may be any configuration, materials or method of manufacture known in the art for such purposes. The novel feature of the present invention is the inclusion of the wrap-around foot guard 30.

Figure 2:
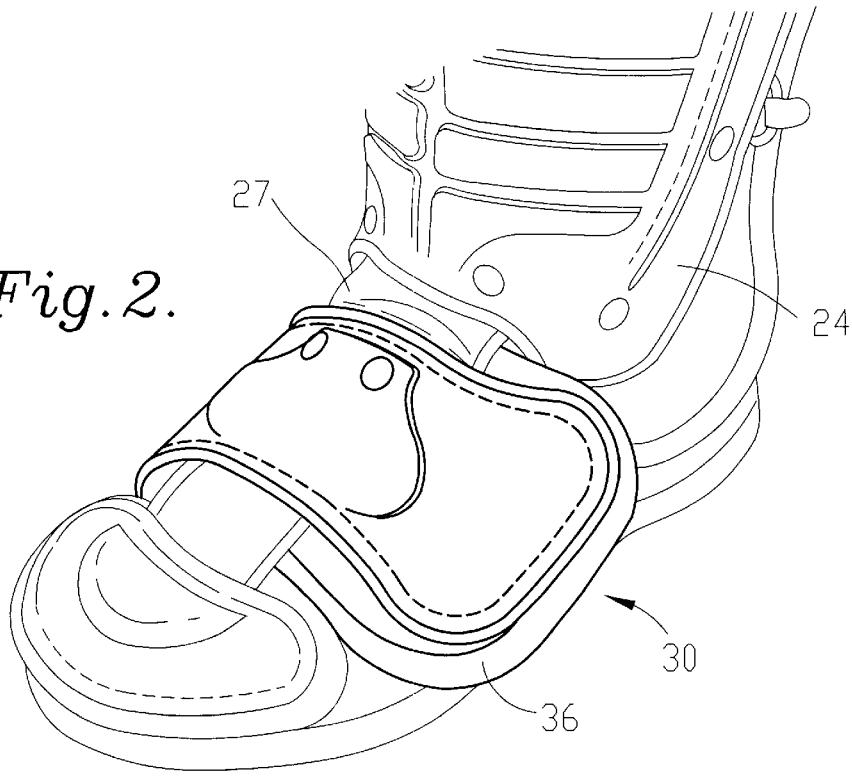
FIG. 2 is a close-up perspective view of the foot guard of FIG. 1.
Figure 3:
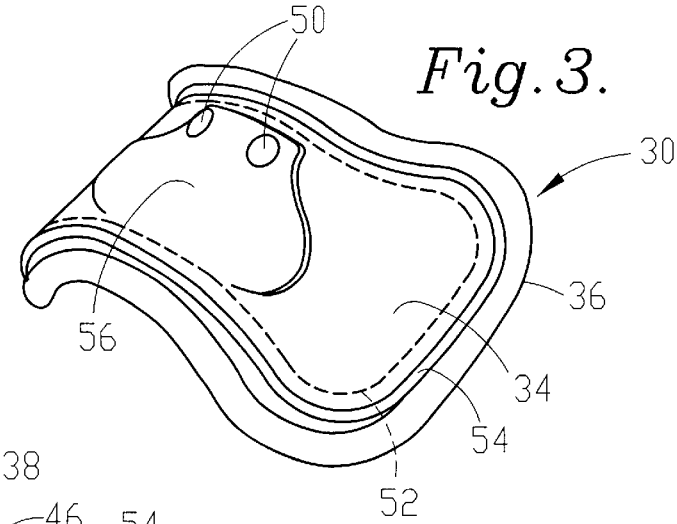
FIG. 3 is a perspective view of the foot guard of FIG. 1.
Figure 4:
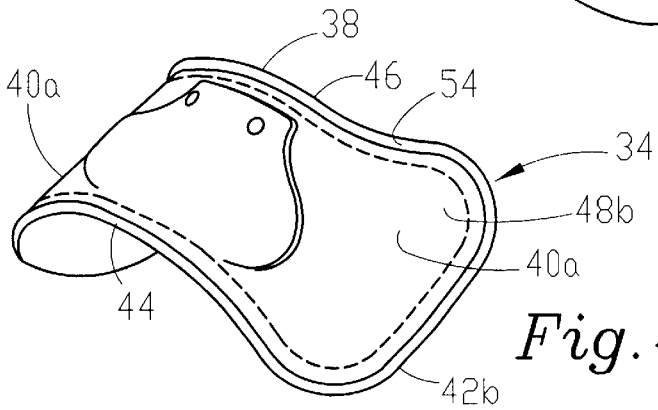
FIG. 4 is a perspective view of the rigid portion of the foot guard of FIG. 1.

Turning to FIGS. 2 and 3, foot guard 30 is flexibly coupled to shin guard 24 by a strap 27, and includes a rigid shell portion 34 backed by a pad 36. Strap 27 is a flexible strap made of any flexible material, such as plastic, leather, vinyl, or nylon. Alternatively, foot guard 30 may be flexibly coupled to shin guard 24 via an extension of the padding 36 of the foot guard 30 or the shin guard 24. It is also understood that more than one strap may used to couple the foot guard 30 to the shin guard 24.

Figure 5:
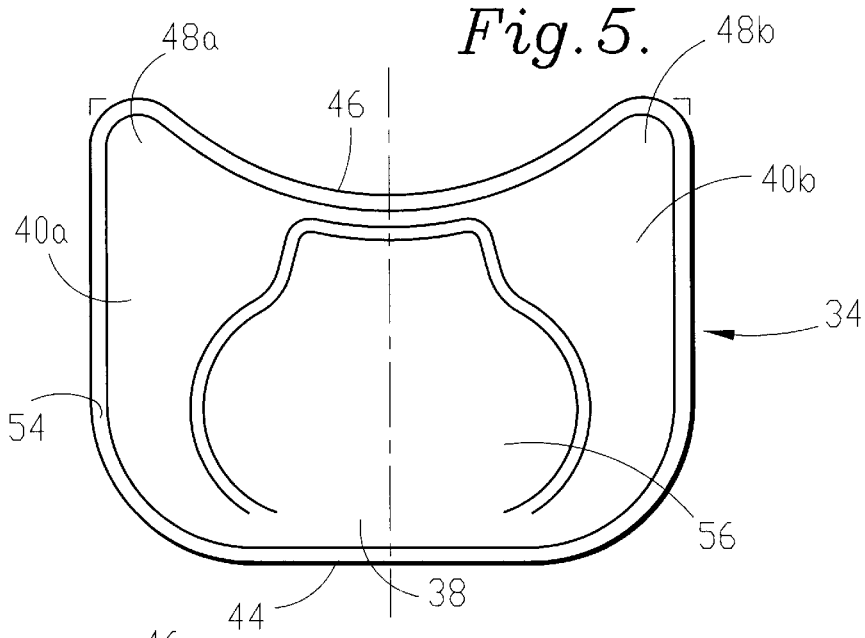
FIG. 5 is a top view of the rigid portion of the foot guard of FIG. 4.
Figure 6:
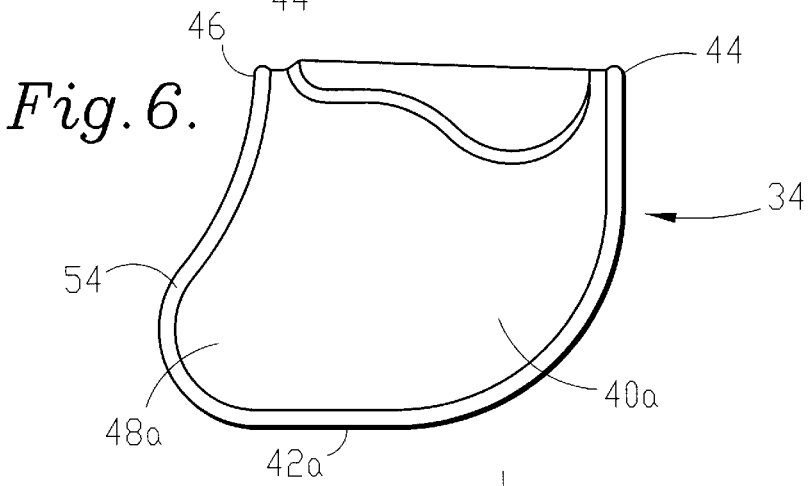
FIG. 6 is a side view of the rigid portion of the foot guard of FIG. 4.
Figure 7:
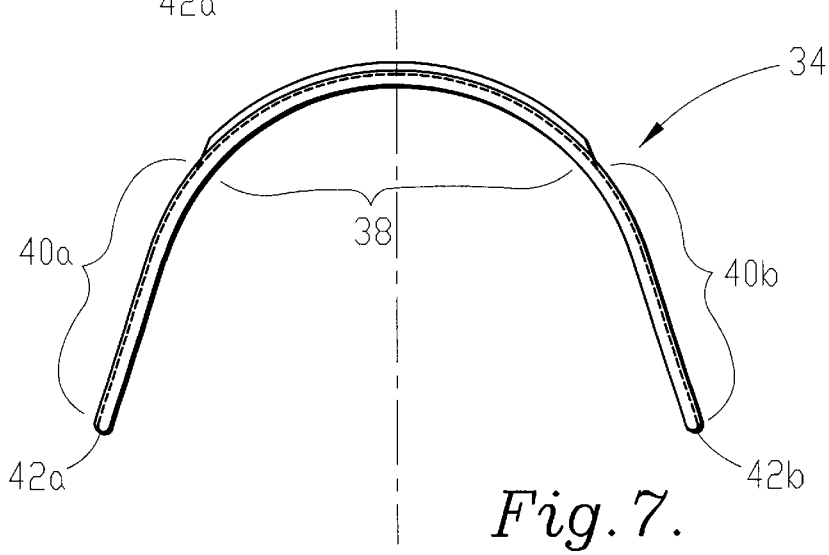
FIG. 7 is an end view of the rigid portion of the foot guard of FIG. 4.

Looking also to FIGS. 4, 5, 6, and 7, rigid shell 30 is arch shaped having a generally horizontal-extending mid-section 38 configured to extend across the top of a user's foot, and generally vertical-extending opposing sides 40*a*, 40*b* configured to extend downwardly along opposite sides of the user's foot to bottom edges 42*a*, 42*b*, respectively. The width of rigid shell 34 as measured from front edge 44 to rear edge 46 of rigid shell 34 may vary depending upon the size of the user and is preferably sufficient to cover the top of the arch portion of the foot. Preferably the width ranges from 4 inches to 5.5 inches, most preferably for youth league from 4 inches to 5 inches and for adult league from 4.5 inches to 5.5 inches. As shown in FIG. 5, rear edge 46 of rigid shell 34 is convex in shape so as to provide rearnvard extending lobes 48*a*, 48*b* adjacent the bottom edge 42*a*, 42*b* of each side. This configuration enables the top of rigid shell 34 to conform to the shape of the user's ankle, with sides wrapping rearward along the sides of the user's foot past the front of the ankle.

Opposing sides 40*a*, 40*b* are configured to extend downwardly a substantial distance along the sides of a user's foot in order to limit lateral movement of foot guard 30 when in use. In this manner, the adjacent sides of the foot will serve to block lateral movement of the foot guard. A "substantial distance" for purposes of this invention is at least one-fouth of the vertical distance from the top-most point on the top of the foot to the bottom-most point on the bottom or sole of the user's foot when in the standing position. Thus, rigid shell 34 extends at least one-fourth of the way down the sides of the catcher's foot, and most preferably, extends one-half to three-quarters of the way down the sides of the foot. This configuration provides protection to the top and sides of the foot and further acts to secure the foot guard 30 to the catcher's foot. The configuration also serves to restrict shin guard 24 from moving from side-to-side on the catcher's shin as the catcher moves into and out of the catching position, as can occur with existing leg guard designs.

In the preferred embodiment the total length of the foot guard 30 from bottom edge 42*a* to bottom edge 42*b* ranges from 2.5 inches to 3.25 inches, with 2.5 inches to 3.0 inches preferred for youth leagues and 2.75 inches to 3.25 inches for adult leagues. The length of each side from bottom edge 42*a*, 42*b* to merger with mid-section 38 ranges from 3 inches to 5 inches with 3 inches to 4 inches preferred for youth leagues and 4 inches to 5 inches preferred for adult leagues.

As shown in FIG. 3, rigid shell 34 is secured to pad 36 to provide additional protection for the user. Pad 36 generally conforms in shape to the rigid shell and consists of a foam pad covered with material. Rigid shell 30 is attached to pad 36 via rivets 50 and stitching 52, though any attaching method known in the art, such as stapling or gluing, could also be used. In a preferred embodiment, rigid shell 34 is formed with a raised lip 54 around its perimeter to provide additional protection to stitching 52. Raised lip 54 extends upward from the upper face of rigid shell 34 to a height greater than that of stitching 52, and thus protects stitching 52 from damage by scraping or sliding. A raised or embossed area 56 formed integrally with or otherwise fixed to the mid-section of rigid shell 34 provides a surface for placing a logo, wording, identification number, or the like. Rigid shell 34 is preferably constructed from a relatively rigid material so that it will retain its shape in use. Preferably, rigid shell 34 is formed of a plastic material or a metal such as aluminum. Most preferably, the rigid shell 34 is formed of a plastic material selected from the group consisting of polyethylene, polypropylene, polystyrene, polyvinylchloride (PVC), acrylonitrile-butadiene-styrene (ABS) and co-polymers, composites or blends thereof. Rigid shell 34 may be made using any manufacturing technique know in the art, and preferably is made of a plastic using injection molding, extrusion, blow molding, thermo forming, rotational molding, compression molding, or casting. Most preferably, the rigid shell is manufactured of a high density polyethylene material by injection molding.

Since many possible embodiments may be made of the invention without departing from the scope thereof, is to be understood that all matters herein set forth or shown in the accompanying drawings are to be interpreted as illustrative, and not in a limiting sense. For example, while the shape of foot guard 30 shown in the drawings is generally arch-shaped, it is understood that other shapes or configurations could also be utilized to cover a portion of the top and sides of the catcher's foot. Likewise, while the preferred embodiment shown in the drawings shows the rigid shell 34 constructed as a unitary piece, other configurations comprising multiple pieces joined into a single shell are also anticipated by the present invention. The foot guard need not be arch-shaped, but may be formed in other shapes so long as the foot guard is configured to extend a distance along the sides of the user's foot and/or adjacent the ankle so as to limit lateral movement of the foot guard. Furthermore, while the preferred embodiment encompasses a rigid portion and padding secured thereto, it is anticipated that the foot guard may consist of a rigid padding or a shell by itself, as long as the foot guard can retain its shape during use.

While specific embodiments have been shown and discussed, various modifications may of course be made, and the invention is not limited to the specific forms or arrangement of parts and steps described herein, except insofar as such limitations are included in the following claims. Further, it will be understood that certain features and sub-combinations are of utility and may be employed without reference to other features and sub-combinations. This is contemplated by and is within the scope of the claims.

From the foregoing it will be seen that this invention is one well adapted to attain all ends and objectives hereinabove set forth, together with the other advantages which are obvious and which are inherent to the invention.

What is claimed and desired to be secured by Letters Patent is as follows:

1. A foot guard comprising:

a mid-section adapted to be flexibly coupled to a shin guard, wherein said mid-section is substantially symmetrically aligned with said shin guard, and wherein said mid-section is configured to cover at least part of a top of the wearer's foot; and opposing sides extending downward from the mid-section a distance of at least one-half of the way down the sides of a user's foot so as to limit lateral movement of the foot guard when positioned on a user's foot and configured to cover at least a part of a side of the foot.

2. The foot guard of claim 1, wherein said foot guard comprises a rigid shell.

3. The foot guard of claim 2, further comprising a pad secured to said rigid shell.

4. The foot guard of claim 3, wherein said pad is secured to said rigid shell via stitching.

5. The foot guard of claim 3, wherein said pad is secured to said rigid shell via rivets.

6. The foot guard of claim 3, further comprising a raised lip along a perimeter of said rigid shell.

7. The foot guard of claim 6, wherein said rigid shell is manufactured from plastic.

8. The foot guard of claim 6, wherein said rigid shell is manufactured from polystyrene.

9. The foot guard of claim 1, wherein said rigid shell further comprises a logo imprinting area.

10. The foot guard of claim 9, wherein said logo imprinting area is a raised area formed integral with said rigid shell.

11. A leg guard comprising:

a shin guard flexibly coupled to a foot guard, wherein said shin guard is configured to substantially symmetrically cover an anterior portion of a wearer's leg, and wherein said foot guard has a mid-section configured to substantially symmetrically cover at least part of a top of the wearer's foot and opposing sides extending downward a substantial distance of at least one-half of the way down the sides of a user's foot from the mid-section so as to limit lateral movement of the foot guard when positioned on a user's foot, wherein said mid section is substantially symmetrically aligned with said shin guard.

12. The leg guard of claim 11, wherein said foot guard comprises a rigid shell.

13. The leg guard of claim 12, wherein said foot guard further comprises a pad secured to said rigid shell.

14. The leg guard of claim 11, wherein said shin guard is flexibly coupled to said foot guard by at least one strap.

15. The leg guard of claim 13, wherein said shin guard is flexibly coupled to said foot guard via an extension of said.

16. The leg guard of claim 11, wherein said leg guard additionally comprises a lower toe guard flexibly coupled to said foot guard.

17. The leg guard of claim 11, wherein said opposing sides comprise rearwardly extending lobes configured to extend rearward of a front of the user's ankle.

18. The leg guard of claim 17, wherein said foot guard has a concave rear edge to conform to the shape of a user's ankle.

19. The leg guard of claim 11, wherein said opposing sides each extend to a bottom edge and wherein the opposing sides extend downwardly at least one fourth of the total height of a user's foot.

20. A foot guard comprising:

a rigid shell comprising:

a horizontally extending mid-section adapted to be flexibly coupled to a shin guard, wherein said mid-section is substantially symmetrically aligned with said shin guard, and wherein said mid-section is configured to cover a portion of a top of a user's foot;

vertically extending opposing sides configured to extend at least one-half the total height of a user's foot so as to limit lateral movement of the foot guard when in use, said opposing sides having rearwardly extending lobes configured to extend rearward of a front of the user's ankle; and padding secured to said rigid shell.

* * * * *